US005740660A

United States Patent [19]

Rowe

[11] Patent Number: 5,740,660

[45] Date of Patent: Apr. 21, 1998

[54] METHOD AND APPARATUS FOR FORMING SOFT GELATIN CAPSULES CONTAINING PARTICULATE MATERIAL

[75] Inventor: Dennis Rowe, Wootton Bassett, United Kingdom

[73] Assignee: R.P. Scherer Corporation, Troy, Mich.

[21] Appl. No.: 454,124

[22] PCT Filed: Dec. 20, 1994

[86] PCT No.: PCT/GB94/02774

§ 371 Date: May 20, 1996

§ 102(e) Date: May 20, 1996

[87] PCT Pub. No.: WO95/17153

PCT Pub. Date: Jun. 29, 1995

[30] Foreign Application Priority Data

Dec. 20, 1993 [GB] United Kingdom ..... 9325965

[51] Int. Cl.[6] ..... B65B 1/02; B65B 1/38; B65B 9/04; B65B 37/06

[52] U.S. Cl. ..... 53/454; 53/560; 53/561

[58] Field of Search ..... 53/559, 560, 561, 53/453, 454, 473, 503, 266.1, 268; 141/67, 210; 222/71, 73

*Primary Examiner*—Horace M. Culver
*Attorney, Agent, or Firm*—Banner & Witcoff Ltd.

[57] ABSTRACT

Rotary die apparatus for producing filled gelatin capsules comprises two cylindrical rollers mounted with their longitudinal axes substantially parallel and defining a nip therebetween, with at least one roller having a plurality of recesses on its outer surface; and means for feeding gelatin ribbon to each roller surface and thereby to the nip. The apparatus includes a metering system for delivering particulate material between gelatin ribbons at the nip; and means for rotating the rollers in synchronism with the metering system such that particulate material is supplied over a recess in said at least one roller, and the juxtaposed ribbon sections close over the particulate material to form a capsule. Air mechanisms may be used to shape the gelatin ribbon into the roller recesses, and such mechanisms can also be used to facilitate the flow of particulate material in the metering system.

14 Claims, 1 Drawing Sheet

METHOD AND APPARATUS FOR FORMING SOFT GELATIN CAPSULES CONTAINING PARTICULATE MATERIAL

This invention relates to methods and apparatus for the production of soft gelatin capsules containing particulate material. Such capsules are now well established as a means for providing a variety of liquid products such as drugs and dietary supplements in a readily ingestible form.

Known apparatus for producing filled gelatin capsules comprises either flat or rotary dies having recesses against which the capsule wall is shaped. The present invention however, is concerned only with apparatus comprising rotary dies or rollers. Such rotary die apparatus comprises two cylindrical rollers mounted with their longitudinal axes substantially parallel and defining a nip therebetween. A plurality of recesses are formed in the outer surface of at least one of the rollers, and means are provided for feeding gelatin ribbon to each roller surface and thereby to the nip. Such apparatus is described in an article entitled "Soft gelatin capsules: a solution to many tableting problems" published in Pharmaceutical Technology in September 1985.

According to the present invention, rotary die apparatus of the kind described above includes a metering system for delivering particulate material between the gelatin ribbons at the nip. Means are also provided for rotating the rollers in synchronism with the metering system, such that particulate material is supplied over a recess in the roller or rollers to fill a capsule formed therein whereafter the juxtaposed ribbon sections close to seal it. Normally, each recess in one roller is in registry with a complementary recess in the other such that the eventually formed capsules are substantially globular.

Delivery of the fill material at the nip can be enough to force the gelatin ribbon into the recess or recesses, with the result that the eventual capsule is relatively tightly packed, and has a size determined by the quantity of fill material provided. However, it is preferred to provide an additional mechanism for urging the gelatin ribbon into the recesses prior to receipt of the fill material, which mechanism can be an air pressure mechanism. For example, a vacuum could be applied at the base of each recess to draw the gelatin material against the wall. Alternatively, positive air pressure can be applied to the other side of the gelatin ribbon to the same effect.

A preferred metering system is disposed in a wedge mounted at the entrance to the nip, with the wedge defining a conduit extending from the nip to a reservoir or hopper for the particulate material. The cross-section of the conduit must of course be selected to allow flow of the particulate material, and for fill material with a particle size of up to 1200 μm, we have found the conduit diameter of 6 mm to be satisfactory. A passage is coupled to an intermediate section of the conduit in the wedge, and means are included for selectively delivering pressurised air along the passage and down the conduit towards the nip between the gelatin ribbons to force the ribbon into the recesses.

A valve at the top of the conduit in the wedge in the metering system referred to above will normally control the delivery of particulate material. Means are provided for keeping the valve open for a predetermined length of time to allow the requisite metered quantity of particulate material into and through the conduit. The delivery of air is timed to occur prior to the valve opening, and can be used to ensure that the conduit is clear. It can also be maintained while the valve is open to free or loosen particulate material in the reservoir which, after the valve is closed, then falls under gravity to the top of the conduit. In this last option, it is recognised that particulate material over a relatively restricted opening can form a bridge, and this pulse of air can break such a bridge, enabling particulate material to fill a metering space over the valve after it has closed.

The invention will now be described by way of example, and with reference to the accompanying schematic drawings wherein.

Figure 1:
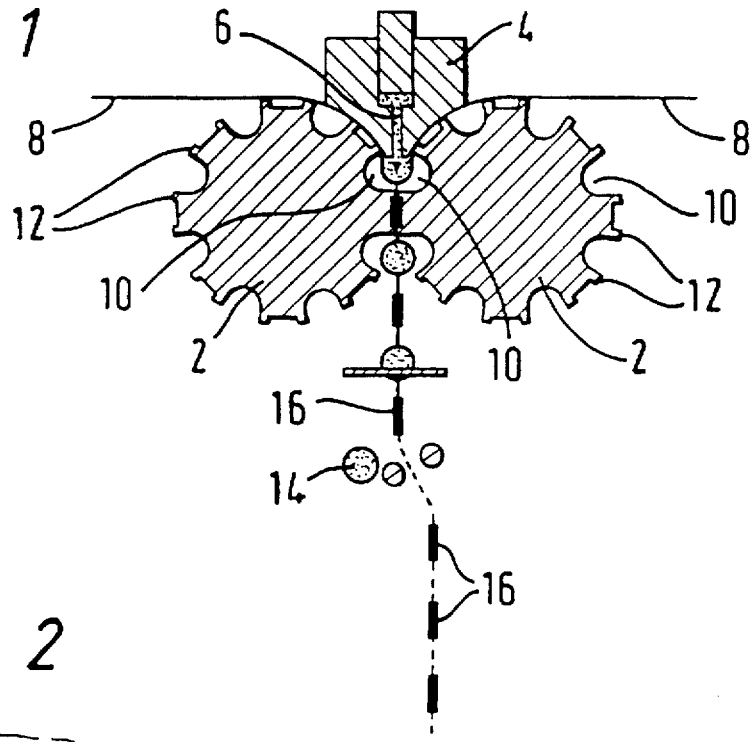
FIG. 1 is a cross-section through a rotary die encapsulation machine of the kind referred to in the article cited above.

The machine shown in FIG. 1 comprises two rollers 2 defining a nip therebetween, above which nip is mounted a wedge 4. FIG. 1 shows an injection system 6 for delivering liquid fill material to the nip as the rollers 2 rotate. Gelatin ribbon 8 (formed elsewhere) is delivered to each roller surface such that it is drawn into the nip from both sides as the rollers rotate.

In the machine illustrated, each roller is formed with a plurality of hemispherical recesses 10 defined at the roller surface by cutting edges or surfaces 12. In use, the rollers 2 rotate in synchronism with each other such that the recesses 10 are in registry at the nip, and with the injection system 6 such that the liquid fill material is injected between the two gelatin ribbons 8 when they are respectively located over the juxtaposed recesses 10. The injected fill material forces each length of gelatin ribbon 8 away from the other and into the respective recess 10, until the capsule is closed by the coming together of the cutting edges and surfaces 12. Capsules 14 are thus produced sequentially with a length 16 of laminated gelatin ribbon therebetween. The cutting edges and surfaces 12 should have separated the lengths 16 from the capsules 14, so that the capsules are produced individually.

In rotary die encapsulation machines of the kind illustrated in FIG. 1 each roller will normally have sufficient axial length to have a substantial number, say twelve, recesses raised along its width. As a consequence, whereas the capsules 14 are produced individually, the laminated ribbons take the form of a perforated sheet which can be drawn away as waste or for recycling.

The machine described above with reference to FIG. 1 is designed to create filled capsules containing liquids. We have developed metering systems which can be used in substantially similar encapsulation machines, and which can deliver metered quantities of particulate material to the nip between the gelatin ribbons. Two such systems are illustrated in FIGS. 2 and 3.

Figure 2:
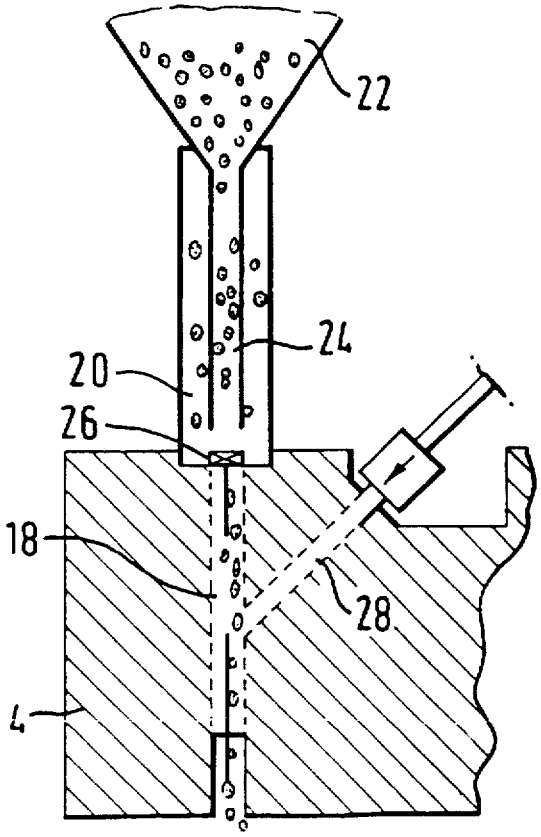
FIG. 2 is an enlarged cross-section through a metering system embodying the invention for use in a machine broadly of the kind shown in FIG. 1.
Figure 3:
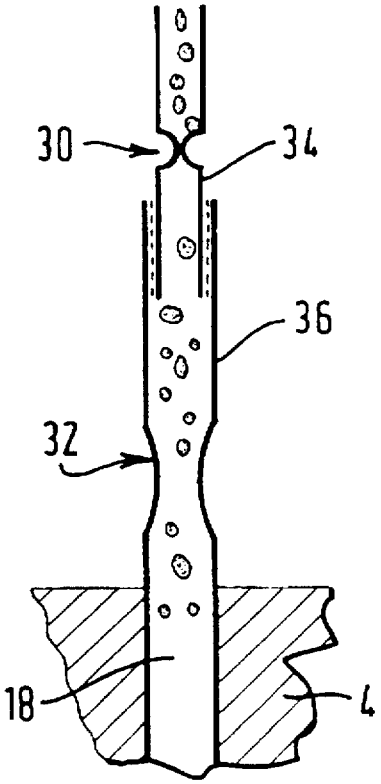
FIG. 3 is an alternative metering system embodying the invention for use in the rotary die encapsulation machine.

In the system shown in FIG. 2, the injection system 6 in FIG. 1 is replaced by a conduit 18 which extends from the nip to a metering space which is itself fed with particulate material from a hopper (not shown) through a funnel 22. The mouth 24 of the funnel 22 extends to near the base of the metering space 20, and a diaphragm valve 26 is located at the junction between the mouth 24 and the conduit 18 to control the delivery of particulate material thereto. Coupled to the intermediate section of the conduit 18 is a passage 28, and the distal end of the passage 28 is connected to means for selectively delivering pressurised air thereto.

Particulate material in the hopper forms a bridge over the mouth 24 of the funnel 22, which prevents its passage down the mouth 24 into the metering space 20. When a pulse of pressurised air is delivered to the conduit 18, in a secondary phase it passes up the conduit 18, through the still open valve 26 and up the mouth 24 to disrupt the bridge and allow the particulate material to fall into the metering space. When the delivery of pressurised air is halted, the bridge reforms and particulate material in the metering space is retained by the valve. At the next blast of air, in a primary phase it is directed down the conduit 18 drawing particulate material in the metering space with it and into the space formed between the gelatin ribbons 8 at the nip between the rollers 2. This phase of the air blast also serves to force the gelatin ribbon 8 into the recesses 10. Thus, a single air blast can be adapted to successively mould the capsule wall; deliver particulate material thereto; and ensure the availability of a predetermined quantity of particulate material for delivery to the next capsule 14.

We have found that in a metering system of the kind described above, a diameter for the conduit 18 and the mouth 24 of the funnel 22, of around 6 mm enables pressurised air to provide satisfactory control while enabling the particulate material to flow in a predictable fashion. The air delivery must of course be determined relative to the size of the metering space and the roller speed as well, to ensure that the delivery of particulate material to the nip can be synchronised with the rotation of the rollers.

The metering system illustrated in FIG. 3 is a dual valve system coupled to the wedge 4 mounted at the entrance to the nip. As in the embodiment of FIG. 2, a conduit 18 is formed in the wedge 4, and diaphragm feed and delivery valves 30 and 32 operable therein deliver metered quantities of particulate material. The metered quantity is defined by the spacing of the valves, and in this embodiment the conduit is made in two telescopically engaged sections 34 and 36 whose relative positions may be adjusted to vary the size of the metering space between the valves. Section 34 is normally held by a screw thread in section 36 so that relative rotation can adjust the size of the metering space.

The diaphragm valves used in the metering system of FIG. 3 are preferably operated by a pneumatic mechanism which can conveniently be coupled with an air pressure mechanism used to urge the gelatin ribbon material into the recesses 10 on the surfaces of the rollers 2 in the encapsulation process.

The metering systems illustrated herein are of course not the only systems that can be used. Known liquid dosing systems can be adapted for use with particulate fill material, although some form of valve will normally be included In the machine described above with reference to FIG. 1, the recesses 10 in the rollers 2 are hemispherical, and result in the formation of spherical capsules. The shape of the recesses 10 can of course be selected according to the capsule shape that is eventually required. We have found that the systems we have developed for filling the capsules with particulate material are particularly effective for elongate capsule shapes. The recesses can be oriented on the rollers with their long dimension extending circumferentially, and we have found this facilitates the delivery of the fill material, and the sealing of the capsule after filling.

While the apparatus described herein is adapted to encapsulate particulate material, it can be used also to encapsulate liquids and particulate material in liquid suspension. In this latter respect, the secondary phase of the air blast used in the first embodiment described can be beneficial.

I claim:

1. Apparatus for producing soft gelatin capsules containing a fill material, comprising two cylindrical rollers mounted with their longitudinal axes substantially parallel and defining a nip therebetween, with at least one roller having a plurality of recesses on its outer surface; and means for feeding gelatin ribbon to each roller surface and thereby to the nip; a metering system disposed in a wedge mounted at the entrance to the nip, for delivering particulate material between gelatin ribbons at the nip, the wedge defining a conduit extending from the nip to a reservoir for the particulate material, and a passage coupled to an intermediate section of the conduit, the apparatus including means for selectively delivering pressurized air along the passage, and down the conduit towards the nip between the gelatin ribbons to force ribbon into the recesses; and means for rotating the rollers in synchronism with the metering system such that particulate material is supplied over a recess in said at least one roller, and the juxtaposed ribbon sections close over the particulate material to form a capsule.

2. Apparatus according to claim 1 wherein each recess in one roller is in registry with a complementary recess in the other roller at the nip such that the eventually formed capsules are substantially globular.

3. Apparatus for producing soft gelatin capsules containing a fill material, comprising two cylindrical rollers mounted with their longitudinal axes substantially parallel and defining a nip therebetween, with at least one roller having a plurality of recesses on its outer surface; and means for feeding gelatin ribbon to each roller surface and thereby to the nip; a metering system disposed in a wedge mounted at the entrance to the nip for delivering particulate material between gelatin ribbons at the nip, the wedge defining a conduit extending from the nip to a reservoir for the particulate material, and a passage coupled to an intermediate section of the conduit, the apparatus including means for selectively delivering pressurized air along the passage, and down the conduit towards the nip between the gelatin ribbons to force the ribbon into the recesses, wherein the delivery means and passage are adapted to direct air in both directions along the conduit, towards the nip for urging the gelatin material into the recesses, and away from the nip to free particulate material in the conduit for discharge towards the nip; and means for rotating the rollers in synchronism with the metering system such that particulate material is supplied over a recess in said at least one roller, and the juxtaposed ribbon sections close over the particulate material to form a capsule.

4. Apparatus for producing soft gelatin capsules containing a fill material, comprising two cylindrical rollers mounted with their longitudinal axes substantially parallel and defining a nip therebetween, with at least one roller having a plurality of recesses on its outer surface; means for feeding gelatin ribbon to each roller surface and thereby to the nip; and a metering system for delivering particulate material between gelatin ribbons at the nip, the metering system comprising a valve system coupled to a wedge mounted at the entrance to the nip, the wedge defining a conduit extending from the valve system to the nip, the valve system being operative in a passage extending from a reservoir for the particulate material to the conduit, with a diaphragm feed valve spaced from a diaphragm delivery valve to define a metering space in the conduit such that a predetermined quantity of particulate material is isolated for delivery to the nip; and means for rotating the rollers in synchronism with the metering system such that particulate material is supplied over a recess in said at least one roller, and the juxtaposed ribbon sections close over the particulate material to form a capsule.

5. Apparatus according to claim 4 wherein the spacing between the feed and delivery valves is adjustable to vary the volume of the metering space.

6. Apparatus according to claim 4 wherein each recess in one roller is in registry with a complementary recess in the other roller at the nip such that the eventually formed capsules are substantially globular.

7. Apparatus according to claim 4 including an air pressure mechanism for forcing the gelatin ribbon into the recesses to receive the particulate material.

8. A method of producing soft gelatin capsules containing particulate material, comprising feeding gelatin ribbon along the surfaces of each of two cylindrical rollers mounted with their longitudinal axes substantially parallel to a nip between the rollers, at least one roller having a plurality of recesses on its outer surface; delivering particulate material in metered quantities between the gelatin ribbons at the nip along a conduit extending from the nip to a reservoir for the material, and selectively delivering pressurized air along a passage coupled to an intermediate section of the conduit, and down the conduit towards the nip between the gelatin ribbons to force the ribbon into the recesses; and rotating the rollers in synchronism with the delivery of particulate material such that the material is supplied over a recess in said at least one roller, and the juxtaposed ribbon sections close over the particulate material to form a capsule.

9. A method according to claim 8 wherein the particulate material is in a liquid suspension.

10. A method of producing soft gelatin capsules containing particulate material, comprising feeding gelatin ribbon along the surfaces of each of two cylindrical rollers mounted with their longitudinal axes substantially parallel to a nip between the rollers, at least one roller having a plurality of recesses on its outer surface; delivering particulate material in metered quantities between the gelatin ribbons at the nip along a conduit extending from the nip to a reservoir for the material, and selectively delivering pressurized air along a passage coupled to an intermediate section of the conduit, and down the conduit towards the nip between the gelatin ribbons to force the ribbon into the recesses, wherein air is directed in both directions along the conduit, towards the nip for urging the gelatin material into the recesses, and away from the nip to free particulate material in the conduit for discharge towards the nip; and rotating the rollers in synchronism with the delivery of particulate material such that the material is supplied over a recess in said at least one roller, and the juxtaposed ribbon sections close over the particulate material to form a capsule.

11. A method of producing soft gelatin capsules containing particulate material, comprising feeding gelatin ribbon along the surfaces of each of two cylindrical rollers mounted with their longitudinal axes substantially parallel to a nip between the rollers, at least one roller having a plurality of recesses on its outer surface; delivering particulate material in metered quantities between the gelatin ribbons at the nip; and rotating the rollers in synchronism with the delivery of particulate material such that the material is supplied over a recess in said at least one roller, and the juxtaposed ribbon sections close over the particulate material to form a capsule wherein the particulate material is delivered through a valve system coupled to a wedge mounted at the entrance to the nip, the wedge defining a conduit extending from the valve system to the nip, and the valve system being operative in a passage extending from a reservoir for the particulate material to the conduit, with a feed valve spaced from a delivery valve to define a metering space in the conduit such that a predetermined quantity of particulate material is isolated for delivery to the nip.

12. A method according to claim 11 wherein the spacing between the feed and delivery valves is adjustable to vary the volume of the metering space.

13. A method according to claim 12 wherein the particulate material is in a liquid suspension.

14. A method according to claim 11 wherein the particulate material is in a liquid suspension.

* * * * *